United States Patent [19]

Karagoz et al.

[11] Patent Number: 4,802,188

[45] Date of Patent: Jan. 31, 1989

[54] WATER TRAP MANIFOLD FOR WATER COOLED ELECTRODES

[75] Inventors: Berch Y. Karagoz, Grand Island; Lyman T. Moore, Niagara Falls; Mark D. Travers, Sanborn; Donald P. Allen, Niagara Falls, all of N.Y.

[73] Assignee: Great Lakes Carbon Corporation, New York, N.Y.

[21] Appl. No.: 780,518

[22] Filed: Sep. 26, 1985

[51] Int. Cl.[4] ..... H05B 7/08

[52] U.S. Cl. ..... 373/93

[58] Field of Search ..... 373/93, 74, 76

[56] References Cited

U.S. PATENT DOCUMENTS 4,121,042 10/1978 Prenn ..... 373/93

4,509,178 4/1985 Lades et al. ..... 373/93

FOREIGN PATENT DOCUMENTS 2825528 12/1979 Fed. Rep. of Germany ..... 373/76

*Primary Examiner*—Roy N. Envall, Jr.

*Attorney, Agent, or Firm*—A. J. Good; R. Laddie Taylor

[57] ABSTRACT

In a water cooled electrode assembly for an electric arc steel furnace, a water trap manifold 14 integral with the head assembly at the upper end of said electrode.

5 Claims, 5 Drawing Sheets

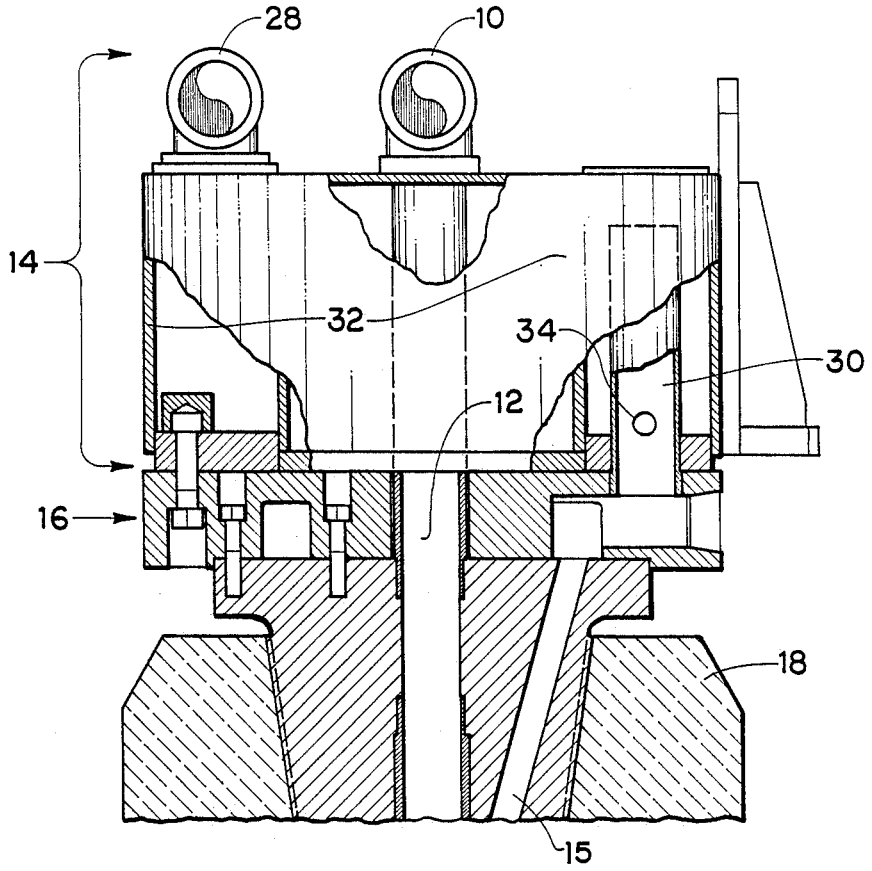
· FIG. 1 ·

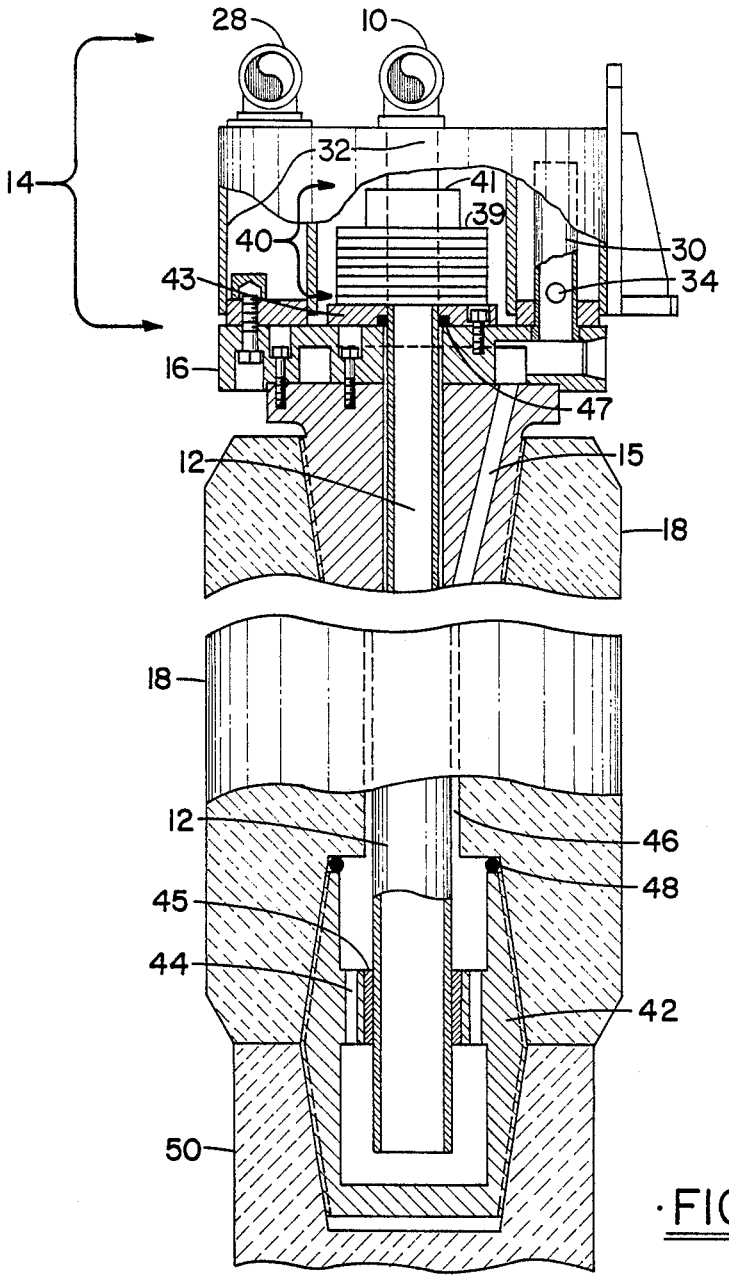
·FIG. 2·

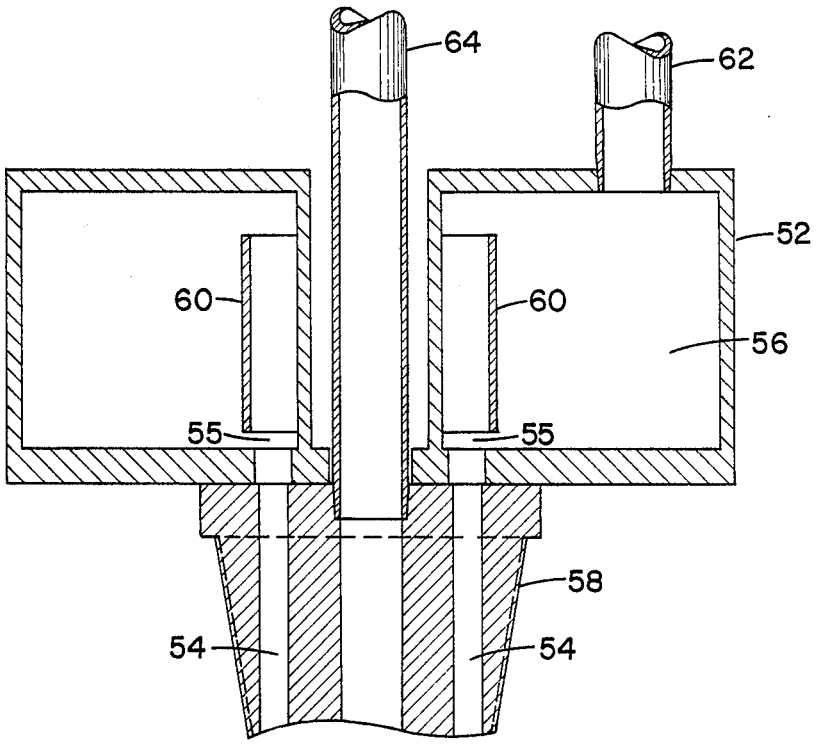
·FIG. 3·

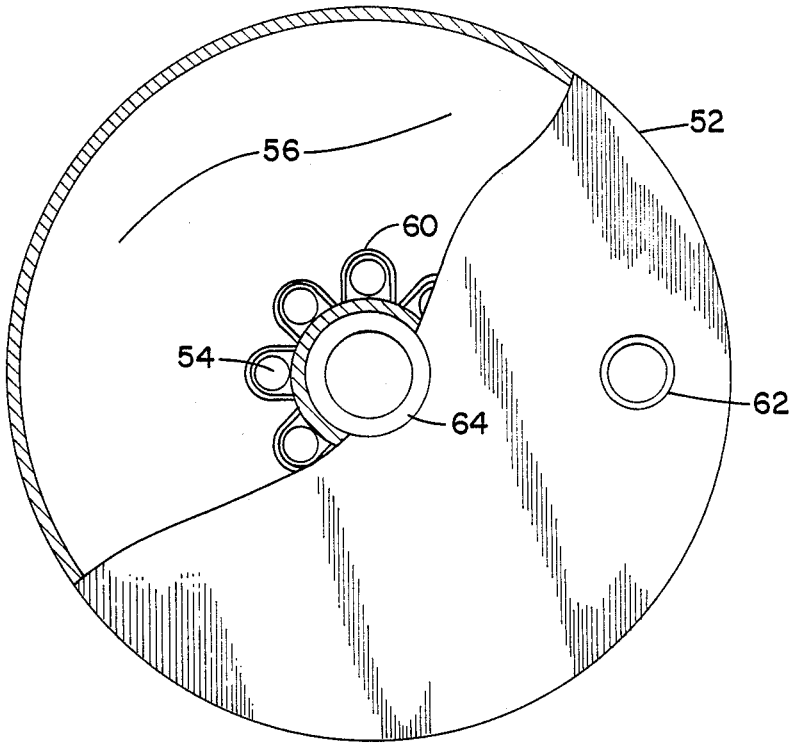
·FIG. 4·

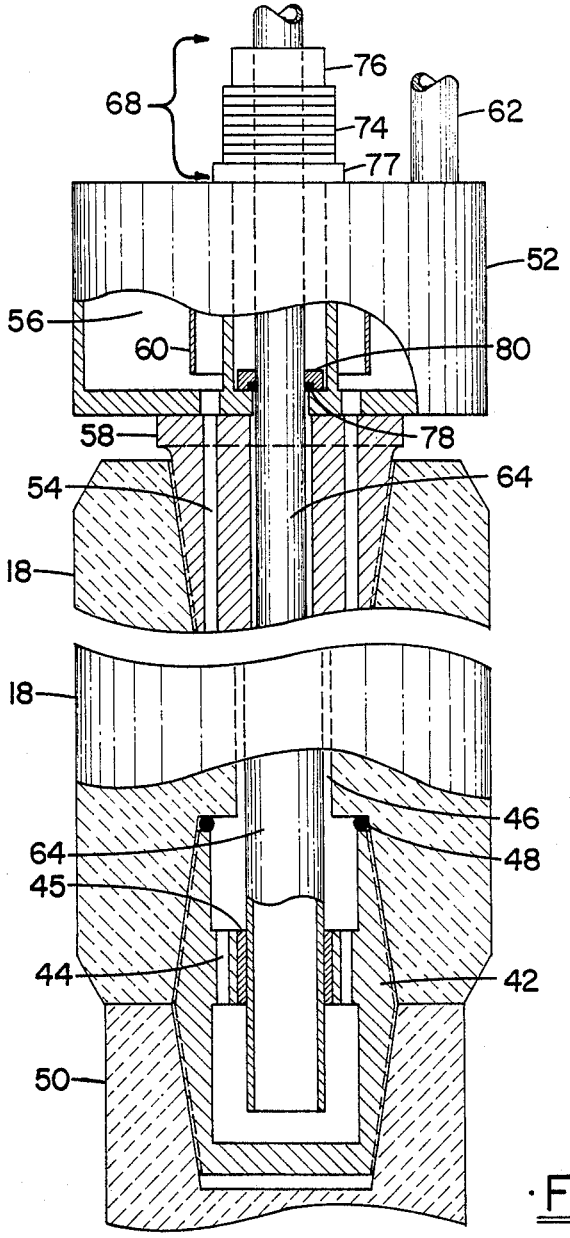
·FIG. 5·

WATER TRAP MANIFOLD FOR WATER COOLED ELECTRODES

RELATED APPLICATIONS CROSS-REFERENCES

This application is related to U.S. Pat. Nos. 4,490,824 4,513,425, and Ser. No. 573,704, incorporated by reference herein.

BACKGROUND OF THE INVENTION

1. Field of the Invention

This invention is related to the field of electric arc technology, and specifically to water-cooled electrodes for electric arc steel furnaces.

The production of steel in recent years has been and is going through a period of great technological change and market instability, resulting in the obsolescence of the open hearth and to a large extent the basic oxygen furnace. The electric arc furnace has come into great prominence due to its relatively low capital cost per ton of steel capacity and its operational flexibility, making it the net lowest cost steel installation.

The principal economic force driving all of the technological changes has been the increase in the cost of oil, which has brought up the cost of competitive fuels and ultimately the cost of all products with a substantial energy input. The graphite used to make electric furnace electrodes has also increased in price to a current price of at least $500/T which makes conservation of the utmost importance. Graphite has long been the material of choice for arc furnace electrodes as it is both thermally and electrically highly conductive, and is resistant to the high temperature of the arc. Consumption of graphite in the furnace is due partially to oxidation and partially due to breakage from falling scrap metal in the furnace and also to some sublimation in the arc. A reduction in consumption of graphite electrodes is highly desirable. The invention herein described is part of an electrode system having lowered graphite consumption and other operating advantages as compared to solid electrodes.

2. Description of Related Art

Related art under 37CFR 1.97–1.99 is disclosed below.

There have been many other previous developments in the field including U.S. Pat. No. 896,429 to Becket; U.S. Pat. No. 961,139 to Keller; U.S. Pat. No. 2,471,531 to McIntyre et al.; U.S. Pat. No. 3,392,227 to Ostberg; U.S. Pat. No. 4,121,042 and 4,168,392 to Prenn; U.S. Pat. No. 4,189,617 and U.S. Pat. No. 4,256,918 to Schwabe et al.; U.S. Pat. Nos. 4,416,014, 4,417,344 and 4,451,926 to Hogg et al.; European Application Nos. 50,682, 50,683 and 53,200 by C. Conradty; European Pat. No. 77,513, and U.S. Pat. No. 4,498,185 by Von Roll AG. These disclose water-cooled electrode designs intended to lower the costs of operating electric arc furnaces. The problems with the designs above having metal structures include overheating due to eddy currents and catastrophic failures due to side arcing and to uncontrolled release of water into the furnace when failure occurs.

Many systems have been proposed and tried, but all previous attempts have been either partial or total failures. The more complex and sophisticated systems are ill-suited to the rough treatment given them in the typical shop. Although they may operate satisfactorily if handled and maintained properly, their margin for error in handling is small and consequently several catastrophic failures have occurred which have given the whole field a suspect reputation.

During operation of water-cooled electrodes, the operating temperture of the lower portion may become so hot that the water in the electrode boils, with the steam produced blowing the water out of the electrode system. This is a problems for both operational and safety reasons which the invention described here overcomes.

SUMMARY OF THE INVENTION

A water-cooled electrode for an electric arc furnace has a tubular graphite main structure with a water inlet tube terminating in a hollow closed end nipple connecting a tip electrode, or in a counterbored electrode. The nipple is a double truncated cone having the standard external configuration used in arc furnaces with the largest diameter in the center. It may be graphite, iron, aluminum, stainless steel or copper, is preferably copper for heat and electrical conductivity and may be silver plated for maximum heat and electrical conductivity. The electrode string may also comprise several electrode bodies, with hollow nipples traversed by the water inlet tube leading to the lower nipple, or counterbored electrode. The water inlet tube is of smaller diameter than the interior of the electrode, which normally will have the same diameter as the small end or minor diameter of the nipple. Water enters from the tube into the hollow nipple and returns through the electrode bore to a manifold at the upper end of the electrode. The invention herein described is a water trap manifold at the upper end of the electrode. A massive metal piece at the upper end of the electrode is connected by a half-nipple to the threaded socket and carries the water inlet tube and the outlet manifold. Both preferably have quick-change couplings for ease of attachment and removal. A water safety shut off system is normally installed in the supply and drain lines, with a check valve in the electrode itself.

This manifold system has a water trap to prevent the steam produced from blowing out the drain line when the heat flux is sufficient to vaporize the water in the electrode, if the water supply is momentarily disconnected or when other changes from a steady state occur. Baffles in the manifold also assist in stabilizing the coolant flow in the electrode system.

An alternate version of the manifold has multiple water passages leading into the manifold separated from the riser tubes by a gap spacing the riser tube apart from the bottom of the manifold body.

The tubular graphite main structure body is made from a graphite arc furnace electrode with a threaded socket at each end. The central bore wall is preferably sealed to prevent water leakage and infiltration into or through the graphite wall. The exterior surface of the body may be treated with an anti-oxidant either by coating or impregnation. The electrode is normally drilled out with a center hole with a diameter not more than the minor diameter of the socket, leaving a heavy wall thickness preferably at least about ¼ of the outside diameter of the tube. The metal connecting nipple is hollow. A water inlet tube having an outside diameter (OD) smaller than the inside diameter (ID) of the electrode leads into the cavity from a header bringing water into the nipple through the center of the main tube. The water then returns upward to the outlet at the header through the annulus between the water inlet tube and the bore of the main structure. The header is normally attached to the top of the graphite tube by the socket threads in the upper end of the main tube.

The water inlet tube may also be used as the means whereby compression is applied to the main tube. The tube is attached to the nipple and the header and held in tension by a tensioning device at the header. A flat spring, e.g., a Belleville washer, is preferred; but other tensioning devices such as coil springs, air or hydraulic cylinders may also be used.

In the instance in which the graphite tube is to be placed in compression, the Belleville washer assembly is placed in the center of the water trap manifold. A check valve in the supply line also is useful in preventing system instability.

The inner bore of the graphite tube may be coated with a sealant to eliminate leakage and infiltration of water through the graphite. A two-package epoxy coating has been used but other water-resistant surface coatings such as phenolic, alkyd, silicone, polyurethane, polyester or acrylic resins may also be used.

This electrode is highly resistant to the heat and aggressive atmosphere of the electric arc furnace and the top portion of the attached consumable electrode in the furnace stays dark in use indicating efficient cooling to a temperature lower than the oxidation temperature with consequent lessening of oxidation and lower graphite consumption per unit of metal produced, than when using the normal all-graphite solid electrodes.

This electrode also consumes less electricity than prior metal composite electrodes due to the absence of inductive heating losses or parasitic eddy currents which were noted to constitute a high drain on the arc current and to present a large heat loss to the cooling system.

It is a further advantage of the electrode of this invention that when the main structure deteriorates after long service, it may be disassembled, the metal parts used with a new graphite tube, and the failed piece consumed as an electrode in the normal manner.

It is a further advantage of the invention that it affords improved safety and operating effectiveness of the electrode system.

BRIEF DESCRIPTION OF THE DRAWINGS

FIG. 1 is a cutaway cross-section of the basic version of the invention. FIG. 2 is a drawing of the manifold for a prestressed electrode of the type disclosed in U.S. Pat. No. 4,513,425. FIGS. 3 and 4 show an alternate version of the basic manifold of the invention. FIG. 5 shows the manifold of FIG. 3 on an electrode of the type disclosed in U.S. Pat. No. 4,513,425.

DESCRIPTION OF THE PREFERRED EMBODIMENTS

FIG. 1 shows the basic version of the water trap manifold in a cutaway cross-section with water supply 10, connected to central water inlet tube 12 through the center of the water trap manifold 14 on header assembly 16 at the upper end of the graphite body 18.

Water enters through inlet tube 10, traverses tube 12 to the electrode, eventually returning through passage 15 to riser tube 30, chamber 32 and outlet 28. Riser tube 30 is open at the top in doughnut-shaped chamber 32 and is drilled at 34 to allow the water to flow back out while providing an expansion chamber for steam.

FIG. 2 is a version of the electrode assembly with manifold 14 using the prestressed invention disclosed in U.S. Pat. No. 4,513,425. The electrode is placed in compression by applying tension to central inlet tube 12 between Belleville washer assembly 40 washers 39 and lower electrode nipple 42 and tightened with nut 41 seal gland 43 and o-ring seal 47, with water traversing inlet 10 to water inlet tube 12 held in place by threaded spider 45, through passages 44 between water inlet tube 12 and graphite body 18 to passages 15, riser tubes 30 with opening 34 in header 16, manifold 14 and outlet 28. A conventional solid graphite tip electrode 50 is attached to the lower nipple 42, which is sealed with O-ring 48.

The manifold itself is in the configuration of a torus with a rectangular cross-section.

FIG. 3 shows an alternate version of the manifold in cross-section with manifold body 52, passages 54 leading to chamber 56 from half nipple 58, with riser tubes 60, water outlet 62, and water supply pipe 64 Riser tubes 60 are not directly attached to passages 54, but are directly above and on the same axes so as to function as steam risers with the gap 55 serving to allow water to return.

FIG. 4 is a plan view of the manifold of FIG. 3 in cutaway with manifold body 52, riser tube 60, outlet 62 and supply pipe 64. Water enters the electrode through supply pipe 64, circulates through the electrode body and nipple, and returns through the passages in the header to the manifold. If the water in the electrode should boil, the riser tubes 60 allow for the escape of rising steam, while allowing for the downward flow of water from chamber 56 through opening 55 and passages 54.

FIG. 5 shows the manifold of FIG. 3 on a prestressed electrode in which the electrode body 18 is held in compression between Belleville washer assembly 68 and nipple 42 through water supply pipe 64. Belleville washer assembly 68 comprises Belleville washers 74 nut 76 and load washer seal 77. Water enters through supply pipe 64 to nipple 42 held in place by spider 45, flows through passage 44 between supply pipe 64 and graphite body 18 to passages 54 in half nipple 58, to manifold 52 sealed with seal 78 and seal gland 80 to riser tubes 60 in chamber 56 and water outlet 62.

An electrode was made by boring a 4 in. (10 cm) hole in the center of a 16 in. diam. (41 cm)×80 in. (203 cm) graphite electrode and coating the bore with a sealant. The electrode had two threaded truncated conical sockets of the type normally used in the electrode industry. A header assembly including a water trap manifold threaded adapter nipple, O-ring seals, Belleville flat spring washer assembly, tensioning nut, water inlet tube, and water outlet were attached at the upper end and a hollow threaded biconical nipple attached to the inlet tube was attached at the lower end. Tension was applied to the water inlet tube by the tensioning nut, placing the graphite electrode under a substantial compressive force. Graphite has a high compressive strength, and can withstand a high stress in compression. The breaking strength of socket threads limits the amount of compressive stress such that the useful stress is much lower than the ultimate stress limits. A 14 in. (36 cm) solid graphite electrode was attached to the nipple. The electrode was then ready for water hookup and placement in the furnace clamp.

The water inlet tube was stainless steel and the header assembly in this instance was aluminum; however, they could be made from other materials with the required tensile strength. The nipple was copper, but might also have been high-strength graphite, ductile iron, gray iron, steel, aluminum, copper, Invar 36 or other low CTE materials.

The electrode operated in a very satisfactory manner, in contrast to a prior electrode without the water trap manifold, which demonstrated instability in the rate of coolant flow, bumping and spouting in an uncontrollable and dangerous fashion.

Although the preferred embodiment of the electrode has the standard truncated conical threaded sockets at each end identical to those universally used in electric furnaces, fitting the standard biconical nipple, the header and nipple could be attached by other means and the invention is not limited to any specific configuration. The two ends could easily be machined in entirely different manners and the attachments likewise assembled in different manners.

The natural frequency of this design with the graphite in compression, is relatively high, and the column has very low tendency to split due to vibration or oscillation.

The nipples may, of course, be made of a suitable metal such as copper, titanium, Invar or a ferrous alloy, but may also comprise several materials, e.g., a copper-ferrous combination for good conductivity, low cost, high strength and low CTE.

Invar is a nickel alloy with an essentially zero CTE and is described in the ASTM Handbook, 9th Ed., as being composed of 36% Ni, less than 1% of Mn, Si and C combined, and the remainder (63%) Fe.

Most arc furnaces have severely limited working space above the electrodes, making the Belleville washer flat spring tensioning system preferred for its small size and simplicity. A Belleville flat spring washer is a well-known spring manufactured by a large number of suppliers and consists of an elastic dished washer of spring steel.

The minimum electrode wall thickness is determined by the differential between the outside diameter of the electrode and the maximum socket base diameter.

Although the examples disclosed above have a graphite main structure, the water trap manifold of the invention may be used with any of the water-cooled electrodes used in industry, and for that matter with a great many other water-cooled pieces of equipment in which stabilization of the coolant flow is desirable.

We claim:

1. In a water-cooled electrode for an electric arc furnace, the improvement comprising a water trap manifold in the coolant outlet line having means to prevent the loss of coolant while providing for the escape of generated steam during off-furnace transfer of the electrode, said means comprising a chamber having within it a steam riser tube connected with said coolant outlet line and open at its lower and upper ends, said manifold integral with a header assembly at the upper end of said electrode.

2. The electrode of claim 1 wherein the manifold comprises a chamber in the shape of a vertical-walled torus at the upper end of the electrode, the central opening of said torus traversed by a water inlet tube, said chamber having multiple cooling water return passages opening into the bottom of said chamber and connected with cooling water return means in said electrode, said openings directly below and on the same axes and spaced apart from riser tubes attached to the inner wall of said chamber.

3. A water-cooled electrode for an electric arc steel furnace having a water inlet tube within a central bore of a tubular graphite electrode leading to a hollow nipple at the lower end of said electrode, said cooling water returning to the upper end of said electrode through the annulus between said water inlet tube and said central bore to a header assembly at said upper end, said annulus connecting with a coolant passage in said header assembly the improvement comprising a water trap manifold in the water return circuit having a chamber, within the chamber a steam riser tube connected to said coolant passage and perforated at its lower end and open at its upper end, said manifold attached to and mechanically integral with said header assembly at the upper end of said electrode, said riser tube effective to allow downward bleeding of coolant water from said manifold while providing the upward flow and escape of steam from the upper end of said riser tube without spouting of the coolant water.

4. A water trap manifold at the upper end of a water-cooled arc electrode useful to prevent instability of flow due to steam generation in said electrode comprising a water supply tube traversing a central cavity in said manifold to the body of said electrode, a water return connecting to said manifold, a steam riser in said manifold connected to said water return comprising a vertical open-ended tube within said manifold having an opening at its lower end allowing water to flow back into said electrode body while steam escapes at the upper end of said tube into said manifold, a water outlet from said manifold, said manifold having the configuration of a torus.

5. A water trap manifold for a water-cooled arc electrode useful to prevent instability of flow due to a steam generation in said electrode during a period when the water supply to said electrode is shut off comprising a water supply tube traversing said manifold to the body of said electrode, a water return connected to said manifold, a steam riser in said manifold in close proximity to said water return comprising a vertical tube within said manifold having an opening at its lower end allowing water to flow or bleed back into said electrode body while steam escapes at the upper end of said tube into said manifold and to an outlet, outlet from said manifold, said manifold having the configuration of a torus.

* * * * *